US010029899B2

(12) United States Patent
Hao et al.

(10) Patent No.: US 10,029,899 B2
(45) **Date of Patent: *Jul. 24, 2018**

(54) WORK PLATFORM WITH PROTECTION AGAINST SUSTAINED INVOLUNTARY OPERATION

(71) Applicant: JLG Industries, Inc., McConnellsburg, PA (US)

(72) Inventors: Ji Hong Hao, Greencastle, PA (US); Ignacy Puszkiewicz, Hagerstown, MD (US); Bryan Scott Mock, Schellsburg, PA (US); Todd S. Booher, Shade Gap, PA (US); Dorothy Gates Greenberger, Hagerstown, MD (US)

(73) Assignee: JLG INDUSTRIES, INC., McConnellsburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/610,996

(22) Filed: Jan. 30, 2015

(65) Prior Publication Data

US 2015/0144426 A1 May 28, 2015

Related U.S. Application Data

(63) Continuation-in-part of application No. 13/885,720, filed as application No. PCT/US2011/066122 on Dec. 20, 2011, now Pat. No. 9,586,799.

(Continued)

(51) Int. Cl.

| | |
|---|---|
| ***E04G 3/28*** | (2006.01) |
| ***B66F 17/00*** | (2006.01) |
| ***B66F 11/04*** | (2006.01) |

(52) U.S. Cl.

CPC ..... *B66F 17/006* (2013.01); *B66F 11/04* (2013.01); *B66F 11/044* (2013.01)

(58) Field of Classification Search

CPC ..... B66F 17/006; B66F 11/04; B66F 11/042; B66F 11/044; B66F 11/046

See application file for complete search history.

(56) References Cited

U.S. PATENT DOCUMENTS 4,754,840 A * 7/1988 MacDonald ..... B66F 11/044 182/141

4,917,213 A 4/1990 Kessler (Continued)

FOREIGN PATENT DOCUMENTS

CN 201665512 12/2010

CN 202030492 11/2011

(Continued)

OTHER PUBLICATIONS

European Search Report dated May 22, 2014 issued in European Patent Application No. 11852006.3, 8 pp.

(Continued)

*Primary Examiner* — Daniel P Cahn

(74) *Attorney, Agent, or Firm* — Nixon & Vanderhye P.C.

(57) ABSTRACT

A work platform includes a floor structure having a width dimension and a depth dimension and a safety rail coupled with the floor structure. A control panel area is cooperable with the safety rail and includes a sensor support bar having a top cross bar extending along the width dimension and side bars extending substantially perpendicularly from the top cross bar. Each of the side bars includes an upper section extending from the top cross bar inward in the depth dimension to a bent section, and a lower section extending from the bent section outward in the depth dimension to the safety rail. A platform switch that is configured to trip upon an application of a predetermined force may be attached to (Continued)

the sensor support bar. A switch bar may be secured to the control panel area, and the platform switch may be attached to the switch bar.

4 Claims, 11 Drawing Sheets

Related U.S. Application Data

(60) Provisional application No. 61/435,558, filed on Jan. 24, 2011, provisional application No. 61/424,888, filed on Dec. 20, 2010.

(56) References Cited

U.S. PATENT DOCUMENTS 4,979,588 A * 12/1990 Pike et al. ..... 182/18
5,740,887 A 4/1998 Unger
5,992,562 A 11/1999 Boeckman
6,065,565 A * 5/2000 Puszkiewicz ..... B66F 11/04 182/148
6,595,330 B1 7/2003 Henrickson et al.
6,823,964 B2 * 11/2004 Goode ..... A62B 1/22 182/113
6,842,684 B1 1/2005 Kade
6,880,187 B1 4/2005 Johnson
7,397,351 B1 7/2008 Rubin
8,813,910 B2 * 8/2014 Bowden ..... 182/19
9,022,160 B2 5/2015 Smith
9,243,412 B1 * 1/2016 Gallette ..... E04F 21/1861
9,586,799 B2 * 3/2017 Hao ..... B66F 11/044
9,676,602 B2 6/2017 Cummings
9,776,847 B2 10/2017 Mondal
9,783,086 B2 10/2017 Parker
2003/0172598 A1 9/2003 Greer
2004/0173404 A1 * 9/2004 Kobel ..... A62B 1/22 182/2.1
2005/0187712 A1 8/2005 Callaghan et al.
2005/0224439 A1 * 10/2005 Bean ..... B66F 17/006 212/280
2007/0154063 A1 7/2007 Breed
2008/0142713 A1 6/2008 Breed
2008/0144944 A1 6/2008 Breed
2008/0262682 A1 10/2008 Bergsten
2009/0260920 A1 * 10/2009 Cummings ..... B66F 11/046 182/18
2010/0068018 A1 * 3/2010 Maguin ..... B64F 1/32 414/347
2010/0114405 A1 5/2010 Elston
2010/0133043 A1 * 6/2010 Black ..... B66F 11/044 182/148
2010/0200332 A1 * 8/2010 Bowden ..... 182/113
2010/0219018 A1 9/2010 Knaak
2010/0289662 A1 11/2010 Dasilva
2011/0286007 A1 11/2011 Pangrazio
2012/0152653 A1 * 6/2012 Bowden ..... B66F 11/044 182/113
2012/0211301 A1 * 8/2012 Clark ..... B66F 17/006 182/2.2
2013/0153333 A1 * 6/2013 Richards ..... B66F 11/044 182/18
2013/0233645 A1 9/2013 Hao
2013/0313040 A1 * 11/2013 Cummings ..... B66F 11/046 182/18
2014/0324310 A1 10/2014 Kobayashi
2014/0332314 A1 * 11/2014 Carrillo et al. ..... 182/19
2015/0008073 A1 * 1/2015 Cummings ..... B66F 11/04 182/148
2015/0027808 A1 1/2015 Baillargeon et al.
2015/0144426 A1 5/2015 Hao
2015/0210115 A1 * 7/2015 David ..... B60B 35/10 301/128
2015/0217981 A1 8/2015 Baillargeon
2015/0368082 A1 12/2015 Davis
2016/0075543 A1 3/2016 Lombardo et al.
2016/0221812 A1 8/2016 Puszkiewicz
2016/0264131 A1 9/2016 Chan
2016/0332856 A1 11/2016 Steedley
2017/0008534 A1 1/2017 Nakatsuka
2017/0021764 A1 1/2017 Adams
2017/0107090 A1 4/2017 Mondal
2017/0233232 A1 8/2017 Davis
2017/0241155 A1 8/2017 Johnson
2017/0255966 A1 9/2017 Khoury
2017/0316696 A1 11/2017 Bartel
2018/0022358 A1 1/2018 Fung
2018/0022405 A1 1/2018 Gecchelin

FOREIGN PATENT DOCUMENTS

FR 2 836 468 8/2003
FR 3000200 A1 * 12/2012
GB 2481709 1/2012
GB 2495158 4/2013
JP 62-153098 7/1987
JP 63-142400 9/1988
JP 1-118987 8/1989
JP 4-65299 6/1992
JP 4-77600 7/1992
JP 5-124800 5/1993
JP 2003-221195 8/2003
JP 2011-63352 3/2011
JP 2013-52948 3/2013
JP 2013-545693 12/2013
WO WO 2009/037429 3/2009
WO WO 2011/015815 2/2011
WO WO 2012/001353 1/2012
WO WO 2012/088091 6/2012
WO WO 2014/206982 12/2014

OTHER PUBLICATIONS

Japanese Office Action dated Apr. 23, 2014 issued in Japanese Patent Application No. 2013-544880 and English Translation, 6 pp.
Australian Patent Examination Report No. 1 dated Mar. 31, 2015 issued in Australian Patent Application No. 2011349306, 3 pp.
Chinese Office Action dated Apr. 28, 2015 issued in Chinese Patent Application No. 201180053891.1 and English translation, 13 pp.
European Search Report dated Apr. 6, 2017 issued in European Patent Application No. 16198347.3, 9 pp.
Australian Examination Report dated Oct. 13, 2017 issued in Australian Patent Application No. 2016256781, 5 pp.
Japanese Office Action dated Oct. 3, 2017 issued in Japanese Patent Application No. 201624158 and English translation, 6 pp.
Extended European Search Report dated Nov. 8, 2017 issued in European Patent Application No. 17163943.8, 11 pp.
U.S. Office Action dated Dec. 20, 2017 issued in U.S. Appl. No. 15/094,286, 25 pp.
U.S. Office Action dated Feb. 14, 2018 issued in U.S. Appl. No. 14/950,845, 24 pp.

* cited by examiner

WORK PLATFORM WITH PROTECTION AGAINST SUSTAINED INVOLUNTARY OPERATION

CROSS-REFERENCES TO RELATED APPLICATIONS

This application is a continuation-in-part (CIP) of U.S. patent application Ser. No. 13/885,720, filed May 16, 2013, pending, which is the U.S. national phase of PCT International Patent Application No. PCT/US2011/066122, filed Dec. 20, 2011 which designated the U.S. and claims priority to U.S. Provisional Patent Application No. 61/424,888, filed Dec. 20, 2010 and U.S. Provisional Patent Application No. 61/435,558, filed Jan. 24, 2011, the entire contents of each of which are hereby incorporated by reference.

STATEMENT REGARDING FEDERALLY SPONSORED RESEARCH OR DEVELOPMENT (NOT APPLICABLE)

BACKGROUND OF THE INVENTION

The invention relates to work platforms and, more particularly, to a work platform including provisions to enhance protection for an operator from sustained involuntary operation resulting in an impact with an obstruction or structure.

Lift vehicles including aerial work platforms, telehandlers such as rough terrain fork trucks with work platform attachments, and truck mounted aerial lifts are known and typically include an extendible boom, which may be positioned at different angles relative to the ground, and a work platform at an end of the extendible boom. On or adjacent the platform, there is typically provided a control console including various control elements that may be manipulated by the operator to control such functions as boom angle, boom extension, rotation of the boom and/or platform on a vertical axis, and where the lift vehicle is of the self-propelled type, there are also provided engine, steering and braking controls.

A safety hazard can occur in a lift vehicle including a work platform when an operator is positioned between the platform and a structure that may be located overhead or behind the operator, among other places. The platform may be maneuvered into a position where the operator is crushed between that structure and the platform, resulting in serious injury or death.

BRIEF SUMMARY OF THE INVENTION

It would be desirable for a platform to incorporate protective structure to enhance protection of the operator from continued involuntary operation of the machine in proximity to an obstruction or structure. The protecting structure can also serve as a physical barrier to enhance protection for the operator and/or cooperate with the drive/boom functions control system to cease or reverse movement of the platform. If cooperable with the operating components of the machine, it is also desirable to prevent inadvertent tripping of the protective structure.

In an exemplary embodiment, a work platform includes a floor structure having a width dimension and a depth dimension and a safety rail coupled with the floor structure and defining a personnel work area. A control panel area is cooperable with the safety rail and includes a sensor support bar having a top cross bar extending along the width dimension and side bars extending substantially perpendicularly from the top cross bar. The side bars define a width of the control panel area. Each of the side bars includes an upper section extending from the top cross bar inward in the depth dimension to a bent section, and a lower section extending from the bent section outward in the depth dimension to the safety rail.

In one embodiment, a platform switch that is configured to trip upon an application of a predetermined force is attached to the sensor support bar. A switch bar is secured to the control panel area, and the platform switch is attached to the switch bar.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
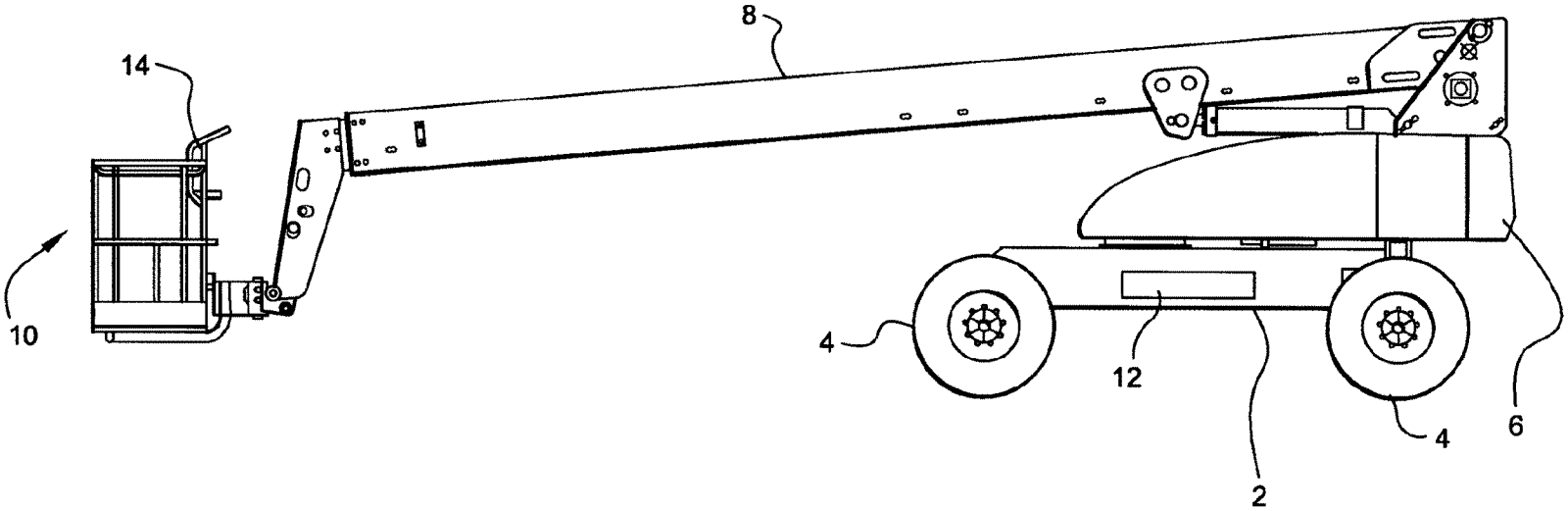
FIG. 1 illustrates an exemplary lift vehicle.

FIG. 1 illustrates an exemplary typical aerial lift vehicle including a vehicle chassis 2 supported on vehicle wheels 4. A turntable and counterweight 6 are secured for rotation on the chassis 2, and a lifting assembly/extendible boom assembly 8 is pivotably attached at one end to the turntable 6. An aerial work platform 10 is attached at an opposite end of the extendible boom assembly 8. The illustrated lift vehicle is of the self-propelled type and thus also includes a driving/control system (illustrated schematically in FIG. 1 at 12) and a control console 14 on the platform 10 with various control elements that may be manipulated by the operator to control such functions as boom angle, boom extension, rotation of the boom and/or platform on a vertical axis, and engine, steering and braking controls, etc.

Figure 2:
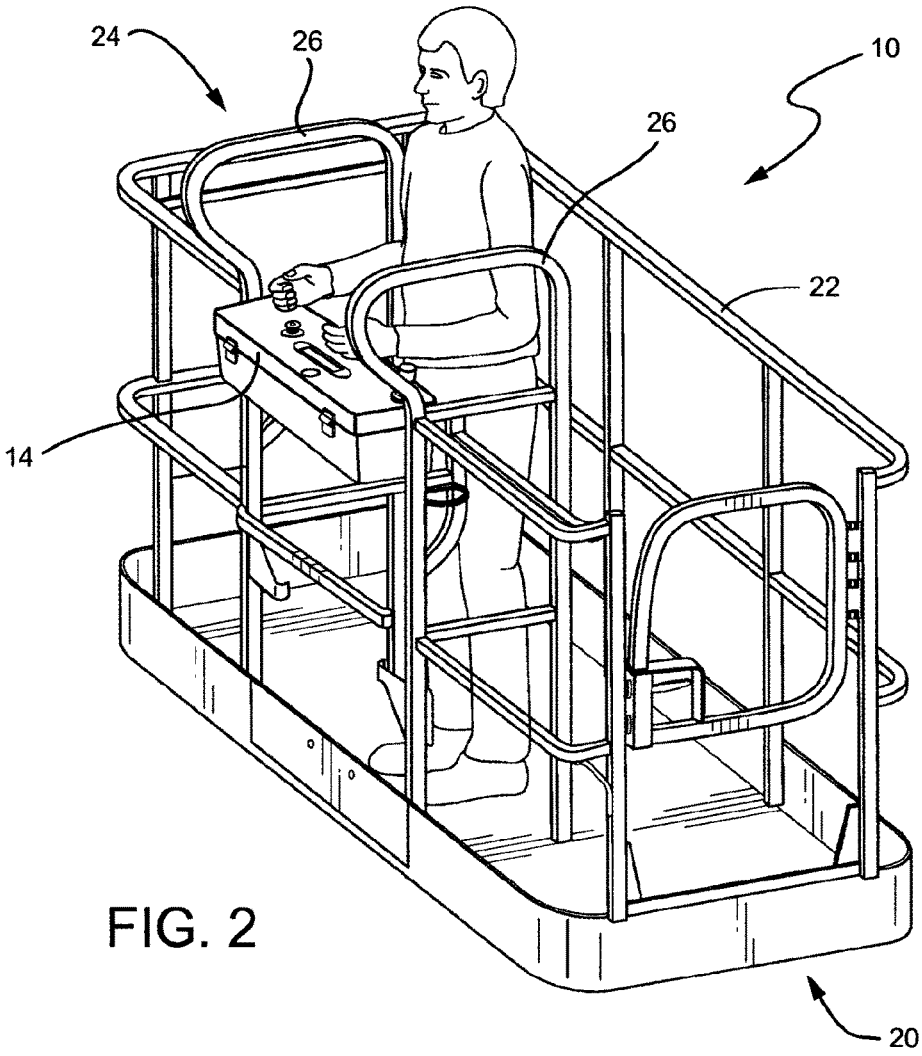
FIGS. 2-3 show a work platform including a protection envelope of a first embodiment.
Figure 3:
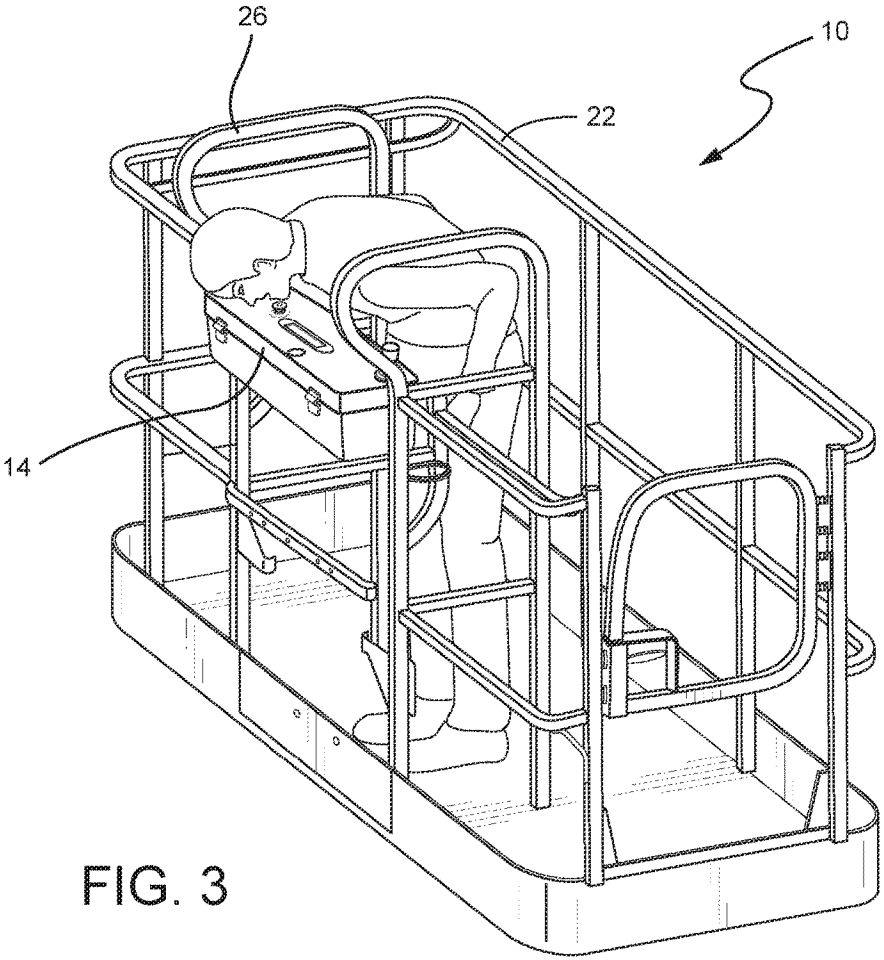

FIGS. 2 and 3 show an exemplary work platform 10 including a protection envelope according to a first embodiment of the invention. The platform 10 includes a floor structure 20, a safety rail 22 coupled with the floor structure 20 and defining a personnel work area, and a control panel area 24 in which the control panel 14 is mounted. The protection envelope surrounds the control panel area 24 and serves to enhance protection for the operator from an obstruction or structure that may constitute a crushing hazard.

As shown in FIGS. 2 and 3, the protection envelope may include protection bars 26 on either side of the control panel area 24 extending above the safety rail 22. The safety rail 22 includes side sections (the longer sections in FIGS. 2 and 3)

and end sections (the shorter sections in FIGS. 2 and 3). The control panel area 24 may be positioned within one of the sidesections. In one construction, the protection bars 26 are disposed intermediately within the one of the side sections adjacent the control panel area 24. In an alternative construction, the protection bars 26 may be disposed in alignment with the end sections of the safety rail 22. Preferably, the protection bars 26 extend above the safety rail 22 by an amount sufficient to accommodate an anteroposterior diameter of an adult human (i.e., a distance between a person's front and back). In this manner, if an obstacle is encountered that could result in crushing the operator between the structure and the control panel 14, the operator will be protected from injury by the protection bars 26 with sufficient space between the control panel 14 and a top of the protection bars 26 to accommodate the operator's torso. FIG. 3 shows the user in a "safe" position where an encountered structure is prevented from crushing the operator by the protection bars 26.

Figure 4:
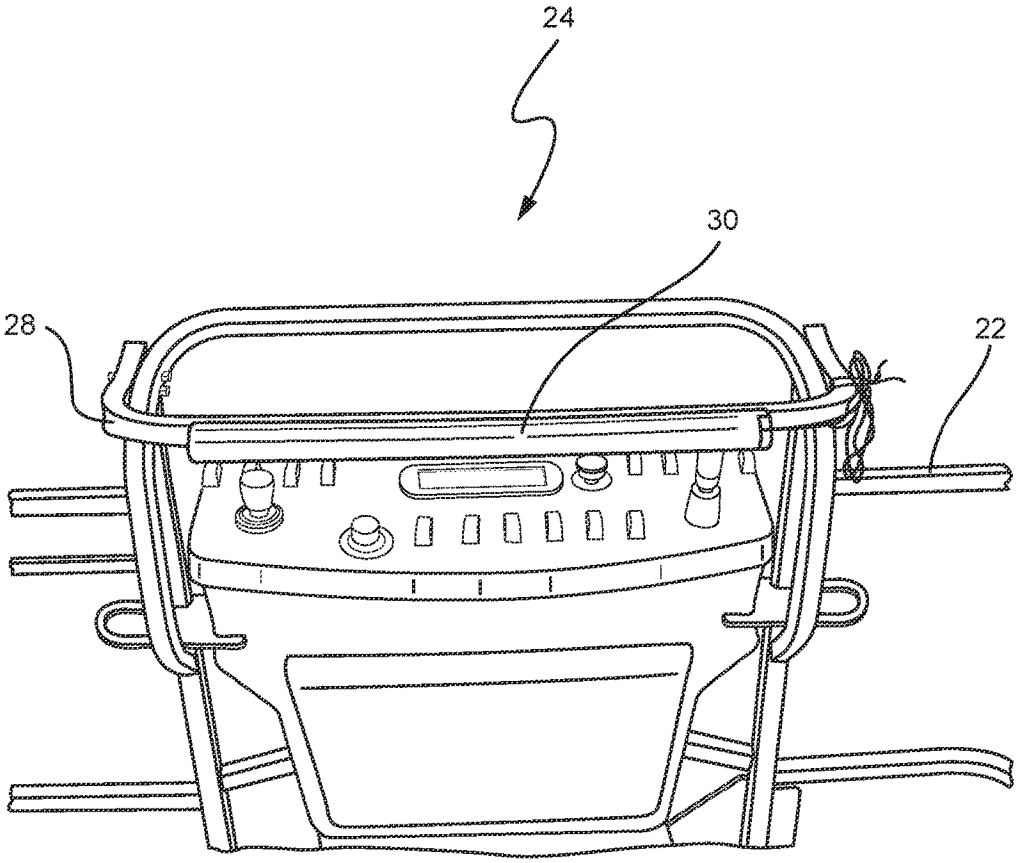
FIG. 4 shows a control panel area and a protective envelope including a platform switch.

An alternative protection envelope is shown in FIG. 4. In this embodiment, the protection envelope includes a switch bar 28 secured in the control panel area 24. A platform switch assembly 30 is attached to the switch bar 28 and includes sensors for detecting the application of a force, such as by an operator being pressed into the platform switch by an obstruction or structure. The platform switch assembly 30 is configured to trip upon an application of a predetermined force. The force causing the platform switch 30 to be tripped may be applied to the platform switch 30 itself or to the switch bar 28 or to both. It has been discovered that inadvertent tripping can be avoided if the predetermined force is about 40-50 lbs over a 6" sensor (i.e., about 6.5-8.5 lbs/in). As shown, the switch bar 28 and the platform switch assembly 30 are positioned between the personnel work area and the safety rail 22. Relative to the floor structure, the switch bar 28 and the platform switch assembly 30 are positioned above and in front of the control panel area 24. Based on an ergonomic study, it was discovered that the switch bar 28 and platform switch assembly 30 should be positioned about 50" above the platform floor.

Figure 5:
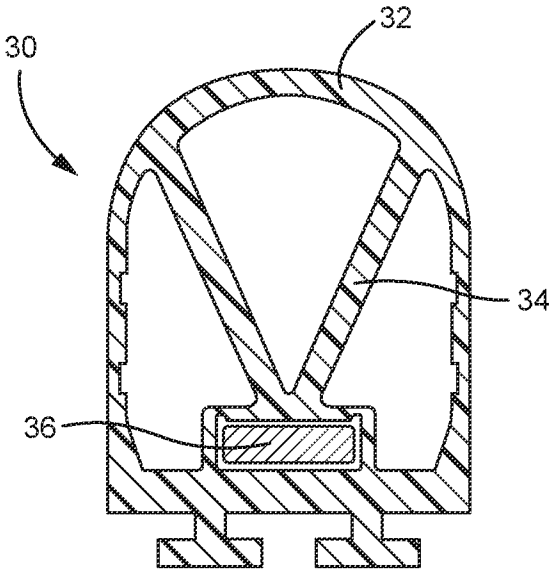
FIG. 5 is a cross-sectional view of the platform switch.

Although any suitable construction of the platform switch assembly 30 could be used, a cross section of an exemplary switch assembly 30 is shown in FIG. 5. The switch assembly 30 includes a switch housing 32 with internal ribs 34 connected between the switch housing and a pressure switch 36. Sensitivity can be adjusted by selecting a different rating pressure switch 36 and/or by adjusting the number, shape and stiffness of the ribs 34. The switch bar 28 and platform switch assembly 30 also serve as a handle bar that an operator can grab in an emergency.

Figure 6:
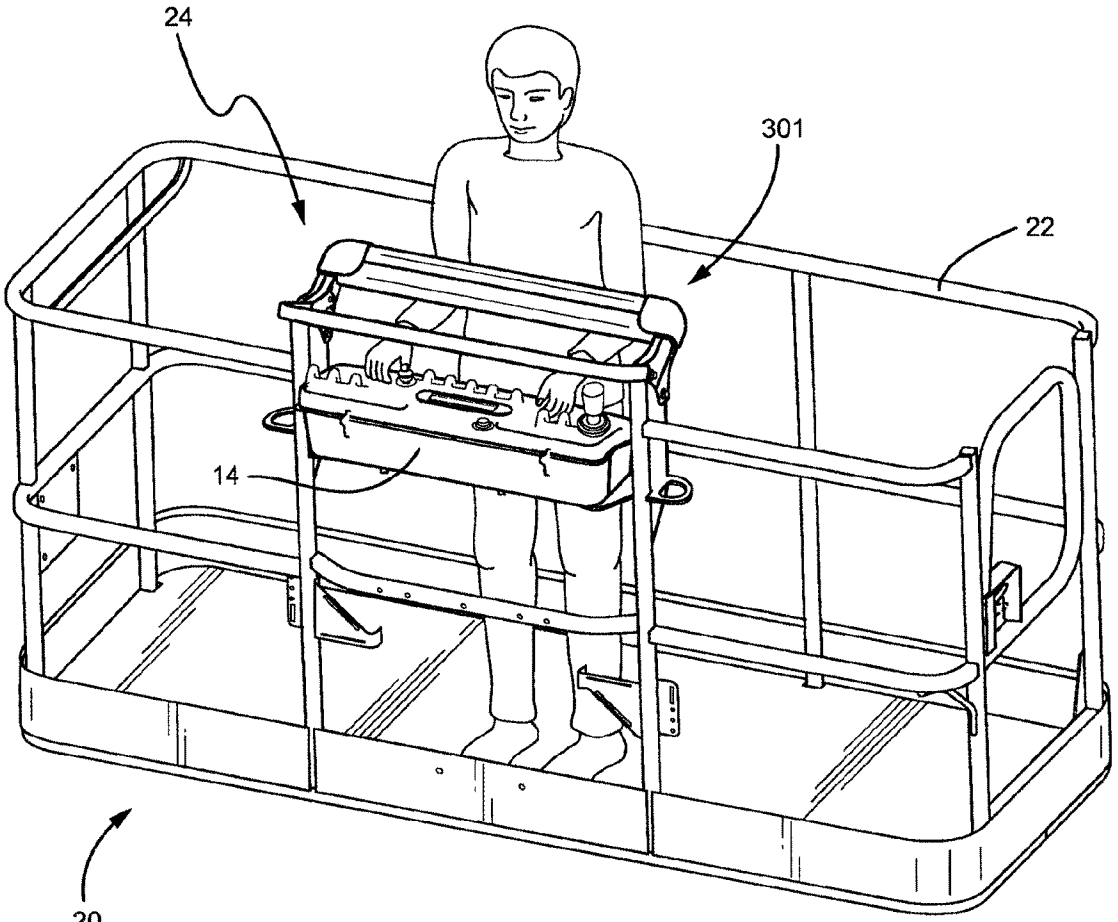
FIGS. 6-7 show an alternative design of the protection envelope including the platform switch.
Figure 7:
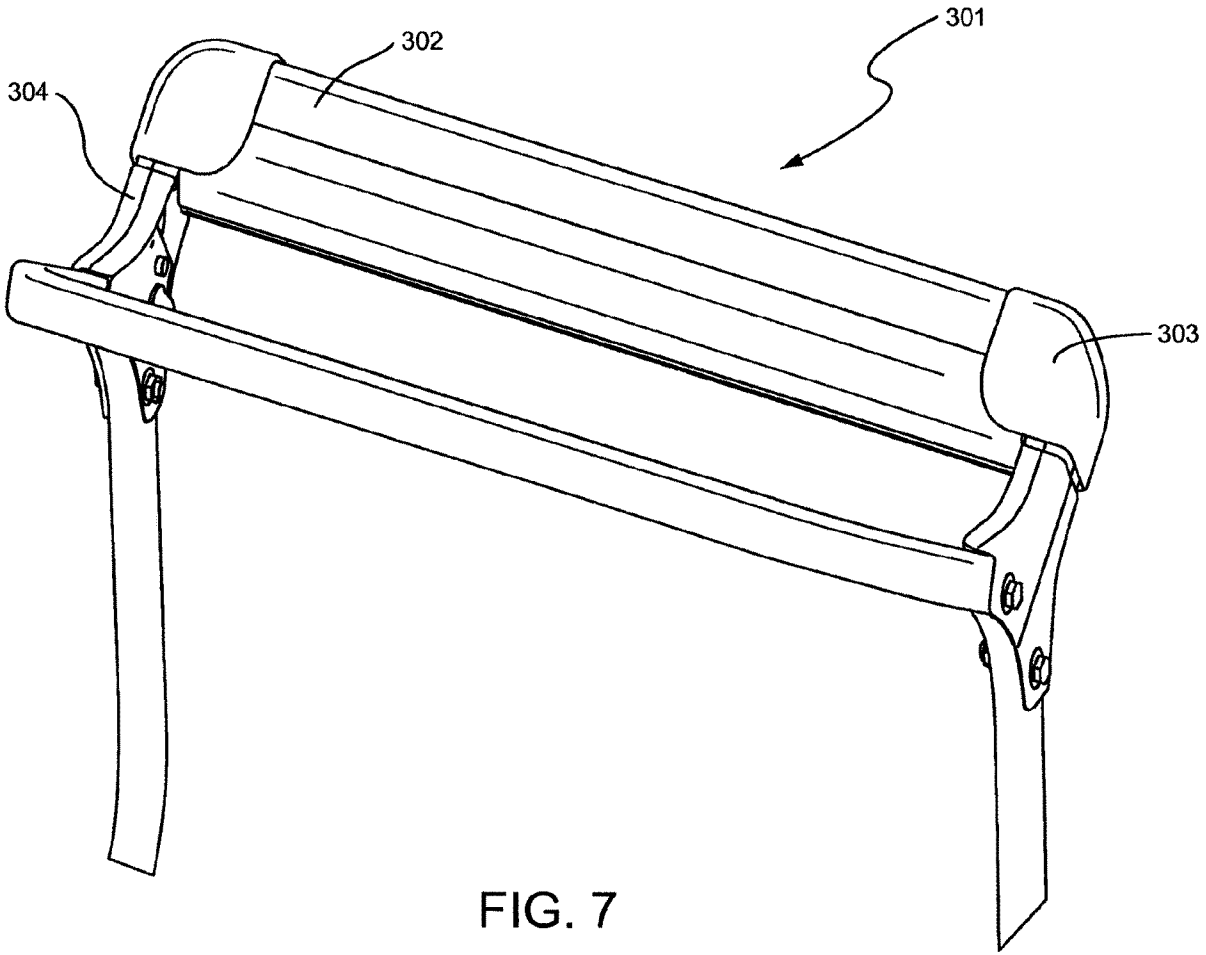

An alternative platform switch assembly 301 is shown in FIGS. 6 and 7. The switch assembly 301 includes a platform switch 302 with injection molded end caps 303 and die cast mounting brackets 304. The platform switch 302 operates in a similar manner to the switch 30 shown in FIGS. 4 and 5. An exemplary suitable switch for the platform switch is available from Tapeswitch Corporation of Farmingdale, N.Y.

Figure 8:
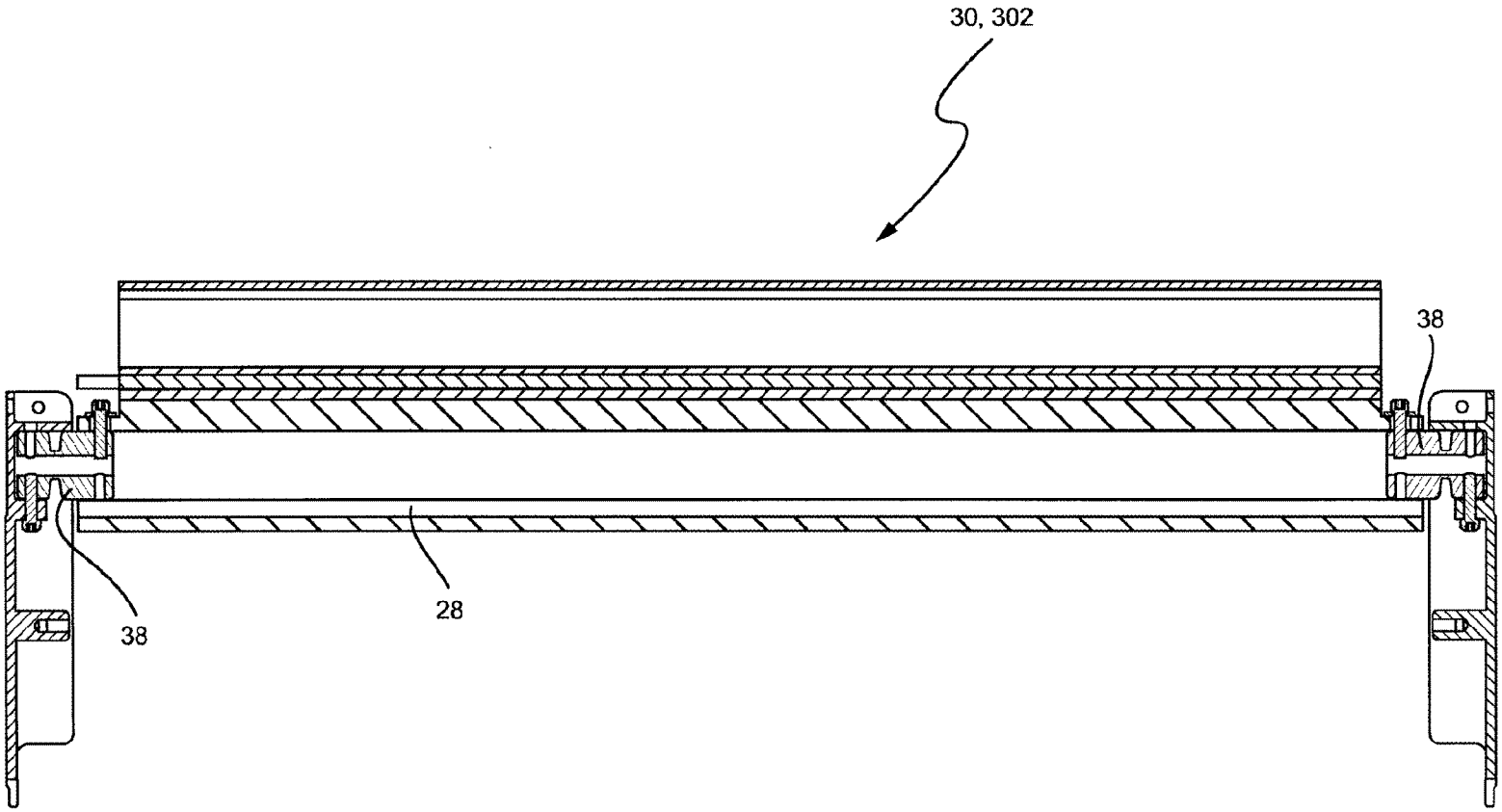
FIG. 8 shows the platform switch connected with shear elements.

With reference to FIG. 8, the platform switch 30, 302 and switch bar 28 may be secured to the control panel area 24 via a shear element 38. The shear element 38 includes a reduced diameter section as shown that is sized to fail upon an application of a predetermined force. With this construction, in the event that the machine momentum or the like carries the platform beyond a stop position after the platform switch is tripped, the shear elements 38 will fail/break to give the operator additional room to avoid entrapment. The predetermined force at which the shear element 38 would fail is higher than the force required to trip the platform switch 30, 301. In one construction, nylon may be used as the material for the shear element 38, since nylon has low relative elongation to plastic. Of course, other materials may be suitable.

In use, the driving components of the vehicle that are cooperable with the lifting assembly for lifting and lowering the work platform are controlled by an operator input implement on the control panel 14 and by the driving/control system 12 communicating with the driving components and the control panel 14. The control system 12 also receives a signal from the platform switch 30, 302 and controls operation of the driving components based on signals from the operator input implement and the platform switch 30, 302. At a minimum, the control system 12 is programmed to shut down driving components when the platform switch 30, 302 is tripped. Alternatively, the control system 12 may reverse the last operation when the platform switch 30, 302 is tripped.

If function cutout is selected, when the platform switch is tripped, the active function will be stopped immediately, and all non-active functions shall not be activated. If a reversal function is selected, when the platform sensor is tripped during operation, the operation required RPM target is maintained, and the active function only when the trip occurred is reversed until the reversal function is stopped. A ground horn and a platform horn can be activated when the reversal function is active. After the reversal function is completed, engine RPM is set to low, and all functions are disabled until the functions are re-engaged with the foot switch and operator controls. The system may include a platform switch override button that is used to override the function cut out initiated by the platform switch. If the override button is pressed and held, it enables the hydraulic functions if the foot switch and controls are re-engaged sequentially. In this event, function speed is set in creep mode speed automatically. The controller is programmed to avoid the cut out feature being disabled before the platform switch is tripped regardless of whether the override button is pressed or released. This assures that the cut out feature will still be available if the override button is stuck or manipulated into an always-closed position.

The reversal function is implemented for various operating parameters of the machine. For vehicle drive, if drive orientation shows that the boom is between the two rear wheels, reversal is allowed only when the drive backward is active and the platform switch is tripped. If a drive forward request is received when the platform switch is tripped, it is treated as a bump or obstacle in the road and will not trigger the reversal function. If the drive orientation shows that the boom is not in line with the rear wheels, then both drive forward and drive backward may trigger the reversal function. Additional operating parameters that are implemented with the reversal function include main lift, tower lift, main telescope (e.g., telescope out only), and swing.

Reversal function terminates based on the platform switch signal, footswitch signal and time parameters that are set for different functions, respectively. If the platform switch changes from trip status to non-trip status before the maximum reversal time is elapsed, then the reversal function will be stopped; otherwise, the reversal function is active until the maximum reversal time is elapsed.

Disengaging the footswitch also terminates the reversal function at any time.

If an operator is trapped on the platform, ground control can be accessed from the ground via a switch. In the ground control mode, if the platform switch is engaged, boom operation is allowed to operate in creep speed. If the platform switch changes status from engaged to disengaged, then operation is maintained in creep speed unless the ground enable and function control switch is re-engaged.

Figure 9:
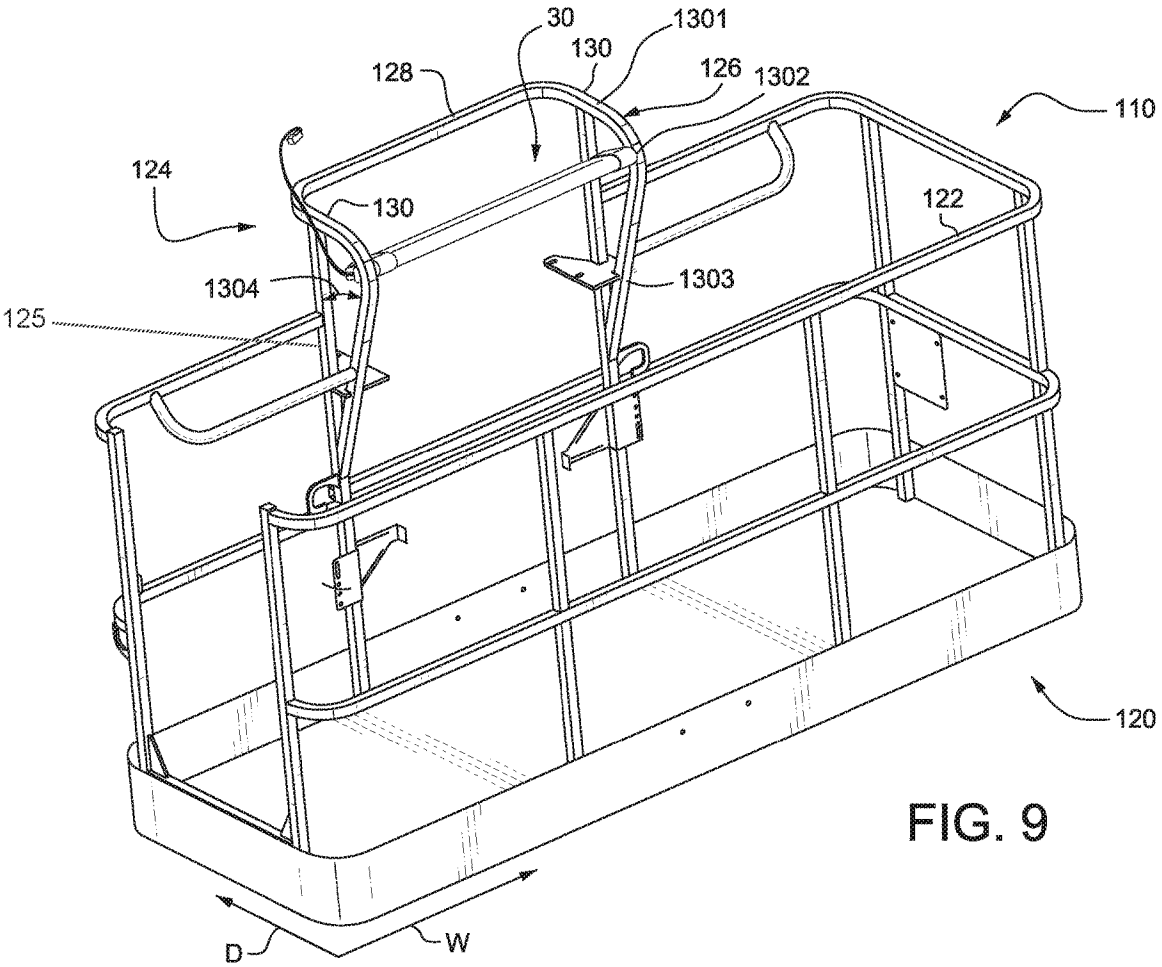
FIG. 9 is a perspective view showing an alternative platform design including the switch bar and platform switch.
Figure 10:
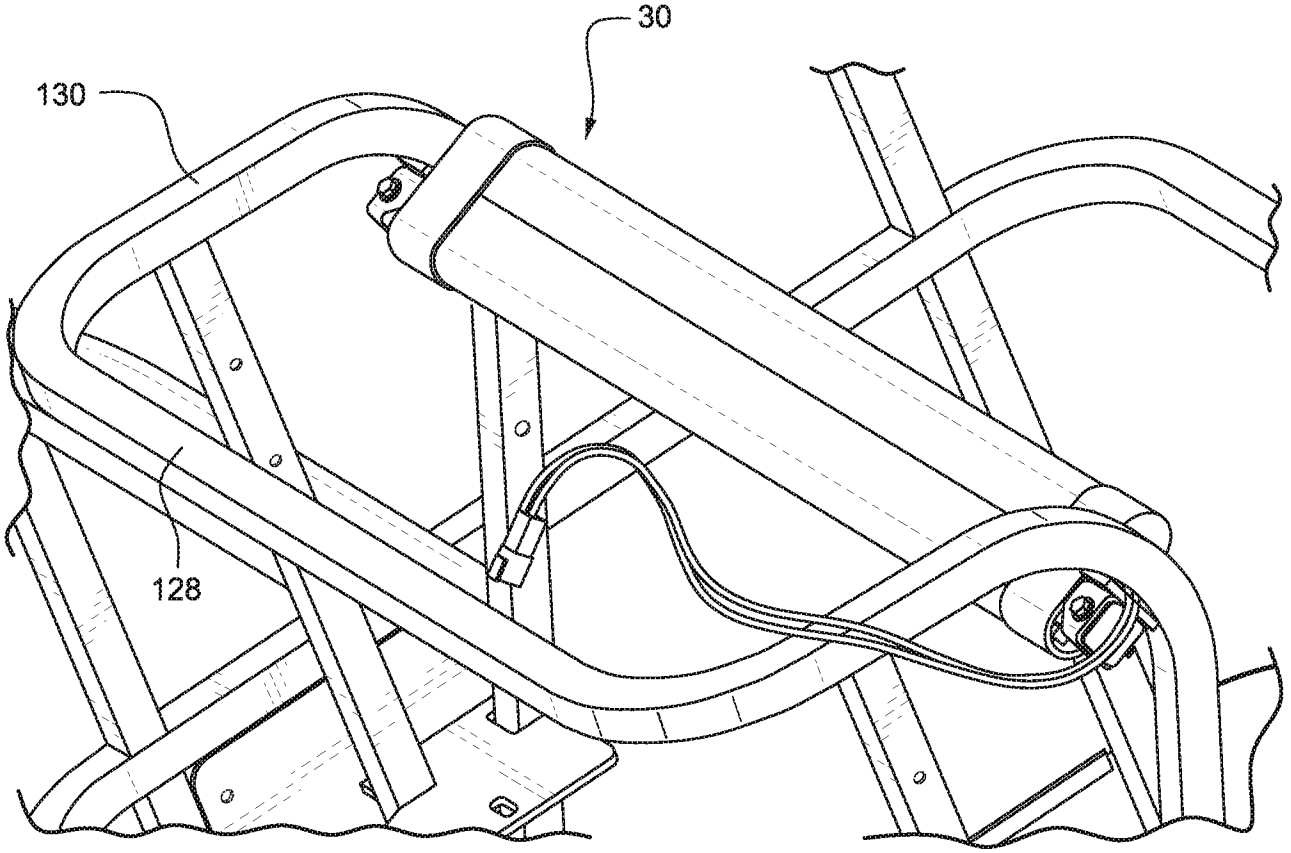
FIG. 10 is a detailed view of the switch bar and platform switch secured to the platform of FIG. 9.
Figure 11:
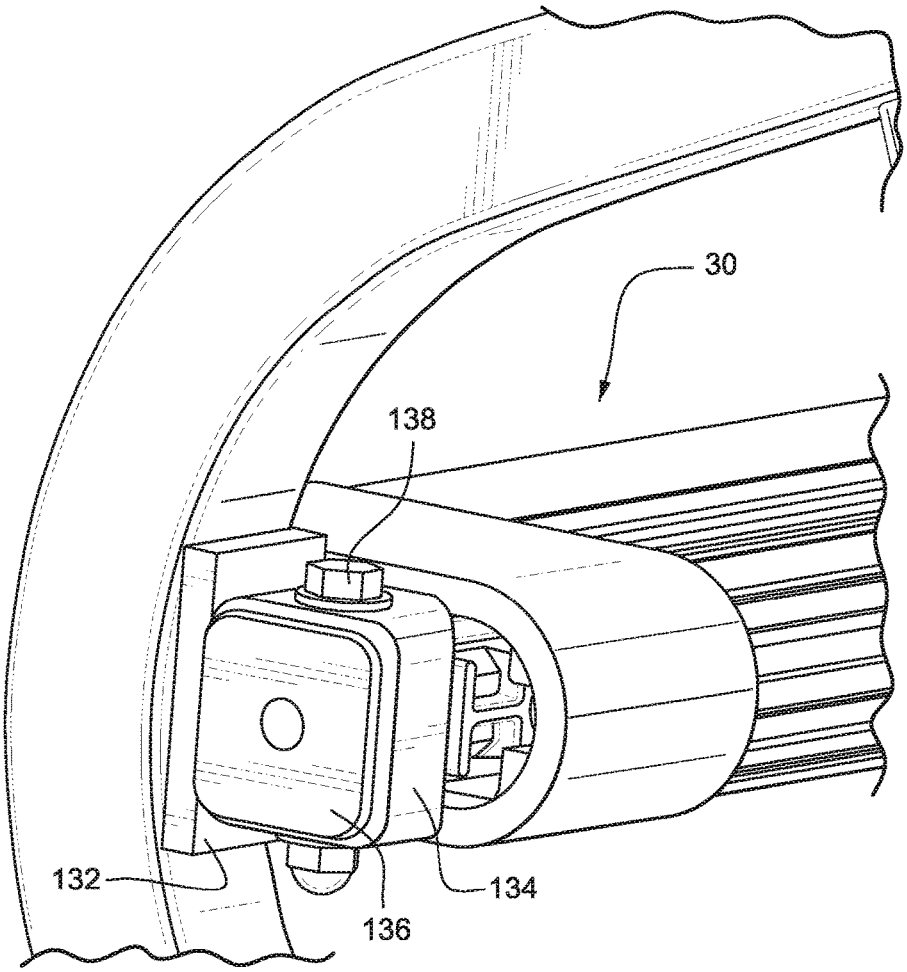
FIG. 11 is a close-up view of the switch bar secured to a sensor support bar of the platform shown in FIG. 9.

FIGS. 9-11 show an alternative work platform 110 including a floor structure 120, a safety rail 122 coupled with the floor structure 120, and a control panel area 124 to which the control panel (not shown) is mounted. The platform switch assembly 30 is secured in the control panel area 124. The control panel area 124 includes support posts 125 secured to the floor structure 120 and extending in a straight line from the floor structure 120 to beyond the safety rail 122. As shown, the safety rail 122 is connected to the support posts 125 and is discontinued between the support posts 125. The control panel area 124 also includes a sensor support bar 126 connected to the support posts 125 and having a top crossbar 128 extending along a width dimension (W in FIG. 9) and sidebars 130 extending substantially perpendicularly from the top crossbar 128. The sidebars 130 define a width of the control panel area 124.

The sensor support bar 126 is preferably bent from a single piece of material, although multiple pieces can be attached to one another in the arrangement shown. Each of the sidebars 130 may include an upper section 1301 extending from the top crossbar 128 inward in a depth dimension (D in FIG. 9) to a bent section 1302. A lower section 1303 preferably extends from the bent section 1302 outward in the depth dimension to the safety rail 122. With continued reference to FIG. 9, the upper section 1301 of the sidebars 130 may be angled downwardly from the top crossbar 128 to the bent section 1302. The lower section 1303 may extend at an angle 1304 from the bent section 1302 to the safety rail 122. As shown, the lower section 1303 may extend in a substantially straight line from the bent section 1302 to the safety rail 122. In the arrangement shown, the safety rail 122 extends above the floor structure 120 to a rail height, where the lower sections 1303 of the sidebars 130 connect to the safety rail 122 at a position about halfway between the floor structure 120 and the rail height. AS also shown in FIG. 9, the top crossbar 128 is preferably positioned above the rail height.

The platform switch assembly 30 may be connected to the sensor support bar 126 at the bent sections 1302 of the sidebars 130 as shown. The platform switch assembly 30 is positioned inward in the depth dimension D of the floor structure such that an operator in the control panel area 124 is closer to the platform switch assembly 30 than to the safety rail 122. Preferably, the platform switch assembly 30 is under-mounted on the sensor support bar 126 relative to an operator standing on the floor structure 120. That is, as shown in FIGS. 10 and 11, the platform switch assembly 30 is preferably coupled to an outside surface of the sensor support bar 126 on an opposite side of the sensor support bar 126 relative to a position of an operator standing on the platform. The under-mounted configuration results in a simpler assembly (e.g., without brackets 304) and improved ergonomics.

FIG. 11 is a close-up view of the platform switch assembly 30 secured to the sensor support bar 126. In a preferred construction, a block 132 is fixed (e.g., by welding) to the sensor support bar 126, and a block holder 134 is fixed (e.g., by welding) to the block 132. The block holder 134 receives a shear block 136 of the platform switch assembly 30 and is secured by a fastener 138 such as a bolt or the like. A similar bolt (not shown) secures the platform switch assembly 30 to the shear block 136.

The protection envelope provided by the described embodiments serves to enhance protection for operators from an obstruction and continued involuntary operation. The protection envelope can include physical/structural protection in the form of protection bars or the like and/or a platform switch that is tripped upon the application of a predetermined force (such as by an operator being driven toward or into the control panel by an obstruction or structure).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An aerial work platform configured to be attached to an end of an extendible boom on a lift vehicle, said aerial work platform comprising:

a floor structure having a width dimension and a depth dimension;

a safety rail coupled with the floor structure and defining a personnel work area; and a control panel area cooperable with the safety rail, the control panel area including:

support posts secured to the floor structure and extending in a straight line from the floor structure to beyond the safety rail, the safety rail being connected to the support posts and being discontinued between the support posts, and a sensor support bar connected to the support posts and having a top cross bar extending along the width dimension and side bars extending substantially perpendicularly from the top cross bar, wherein the side bars define a width of the control panel area, and wherein each of the side bars includes an upper section extending in a straight line from the top cross bar inward in the depth dimension directly to a bent section, and a lower section extending outward directly from the bent section in the depth dimension to a respective one of the support posts, wherein each of the side bars comprises a length extending along the upper section, the bent section and the lower section and includes only one turn between the upper section and the lower section along said length, and wherein the lower section extends at an angle directly from the bent section to the respective one of the support posts and in a straight line from immediately past the bent section to the respective one of the support posts.

2. The aerial work platform according to claim 1, wherein the upper section is angled downwardly with respect to the top cross bar and angled upwardly with respect to the bent section such that the upper section lowers in height as it extends from the top cross bar towards the bent section.

3. The aerial work platform according to claim 1, wherein the safety rail extends above the floor structure to a rail height, and wherein the lower section connects to the respective one of the support posts at a position about halfway between the floor structure and the rail height.

4. The aerial work platform according to claim 3, wherein the top cross bar is positioned above the rail height.

* * * * *